United States Patent [19]

Landis

[11] Patent Number: 4,732,293

[45] Date of Patent: Mar. 22, 1988

[54] TEAR STRIP CLOSURE FOR A CONTAINER WITH A SECURITY RING

[75] Inventor: H. Richard Landis, Oak Lawn, Ill.

[73] Assignee: Landis Plastics, Inc., Chicago Ridge, Ill.

[21] Appl. No.: 927,337

[22] Filed: Nov. 5, 1986

[51] Int. Cl.[4] ..... B65D 17/40

[52] U.S. Cl. ..... 220/276; 220/270; 220/306; 215/256

[58] Field of Search ..... 220/270, 276, 306; 215/256

[56] References Cited

U.S. PATENT DOCUMENTS 4,037,748 7/1977 Stubbs, Jr. ..... 215/256
4,111,329 9/1978 Lampman ..... 215/256

*Primary Examiner*—George T. Hall

*Attorney, Agent, or Firm*—Fitch, Even, Tabin & Flannery

[57] ABSTRACT

An inexpensive, one-piece closure has a press-fit sealed engagement with a container which has a closure retention bead adjacent the open mouth of the container. A tear-off strip provides a tamper-evident feature and includes a pull tab for tearing off the strip thereby exposing a lift tab by which the closure may be lifted from the container. The lift tab is useful where the container has a security or saturn ring on the its sidewall projecting outwardly immediately below the skirt of the closure to limit access to the lower edge of the tear strip. Preferably, the lift-off tab is initially partially hidden behind the pull tab and is connected thereto, and the lift-off tab is exposed and pulled to a position to be accessible after the pull tab is grasped and pulled by the user to remove the tear off strip.

16 Claims, 15 Drawing Figures

TEAR STRIP CLOSURE FOR A CONTAINER WITH A SECURITY RING

BACKGROUND OF THE INVENTION

This invention relates to a plastic closure which is made inexpensively with injection molding equipment, and more particularly, to such a closure which has a tamper-evident band or tear off strip which is removed the first time the closure is open to provide a tamper-evident feature for the container and closure.

The present invention is directed to an inexpensive, one-piece closure which has a press-fit sealed engagement with a container having a closure retention bead or facility adjacent the open mouth. The closure is particularly useable with a container which has a security or saturn ring or ledge on the container side wall projecting outwardly of the container side wall at a location immediately below the skirt of the closure to limit access to the lower edge of a tear strip. Because the container security ring projects radially outwardly from the wall of the container and has a larger outer diameter than that of the closure skirt, it is relatively difficult to obtain direct access to the tear off strip. Also, the security ring protects the strip against accidentally being caught or torn during handling and shipping of the assembled closure and container.

The present invention is particularly useful with closures which has an annular recess or groove in the skirt wall to receive a projecting annular bead on the container to interlock the closure to the container. The closure is pushed onto the container with the closure skirt wall flexing radially outwardly to pass over the container bead until the latter snaps into the recess. The thinnest cross section in the skirt wall is at the bottom of the groove and this provides a line of weakness or a frangible portion at which the lower tear off strip severs from the upper skirt portion. With removal of the tear off strip, the now lower edge of the remaining skirt is at the location of the bead on the container. If one inserts a fingernail under the lower edge of the remaining skirt, the nail hits the container bead and makes removal of the closure difficult. When a security ring is located slightly below this lower edge of the skirt, it is almost impossible to insert a fingernail under the lower edge of the skirt and to remove the closure with a simple lifting motion. The present invention provides a lifting tab which becomes available or accessible with removal of the tear off strip. Thus, the present invention provides a new and improved lift tab that is connected to the container skirt wall and which is spaced above the security ring and projects radially outwardly from the skirt to aid in removal of the closure. Stated differently, removal of the tear strip provides access to a lift tab to lift the closure from the container despite the presence of the container bead and/or a security ring.

The closure and container of the present invention is inexpensively molded in one piece at high speeds and at a relatively low cost. Likewise, the container may be a one-piece molded container of plastic made at high speeds and at low cost. Thus, the invention is directed to a commercially feasible closure and container which can be used for a wide variety of products can be manufactured easily and at high rates to provide an inexpensive closure and/or container.

Accordingly, a general object of the present invention is to provide a new and improved closure with an improved tear off strip and a lift off tab for lifting the closure from the container.

Another object of the present invention is to provide a lift tab for a closure which is disposed within the confines of a pull tab for a tear off ring and which is formed when the tear off strip is removed.

A still further object of the invention is to provide a snap-on, one piece, molded, plastic closure for use with a one-piece, molded plastic container having a tamper-evident tear off strip with a pull tab and a lift tab which is available to lift off the closure despite the presence of a security ring.

These and other objects and advantages of the invention will become apparent from the following description taken in connection with the accompanying drawings in which

DETAILED DESCRIPTION OF THE DRAWINGS

DETAILED DESCRIPTION OF THE PREFERRED EMBODIMENT

Figure 9:
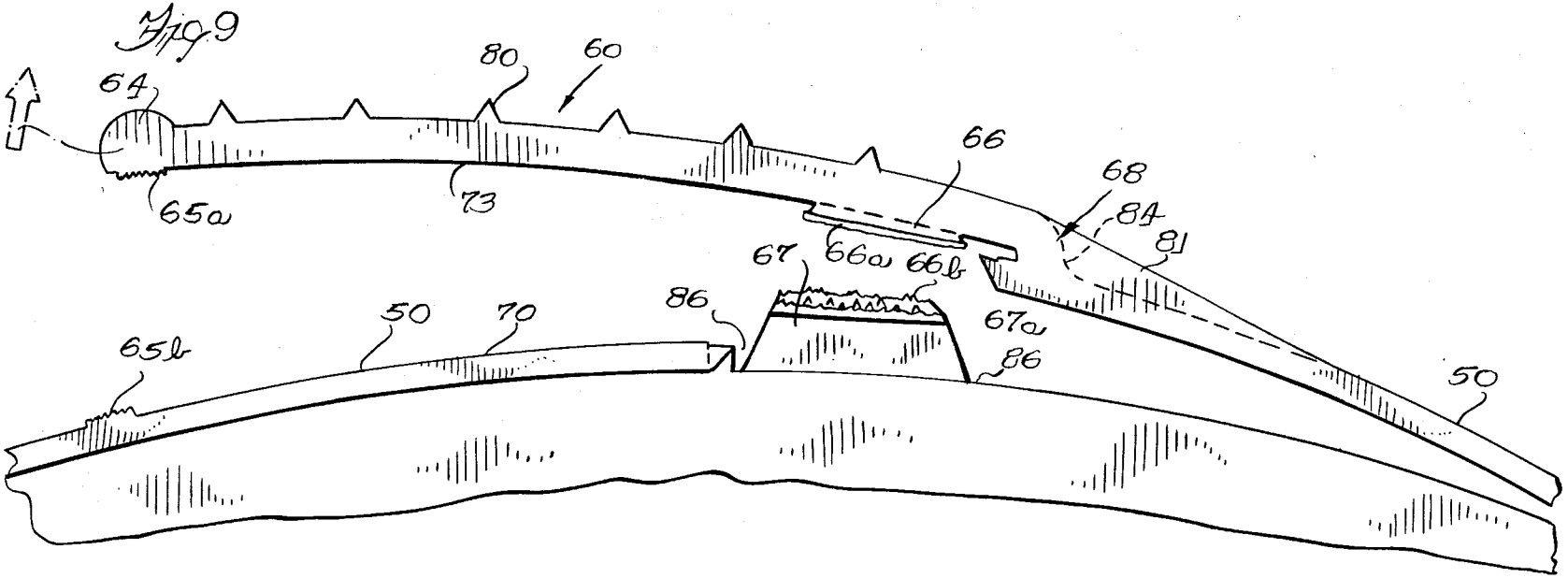
FIG. 9 is a view similar to FIG. 8 with the pull tab detached.
Figure 10:
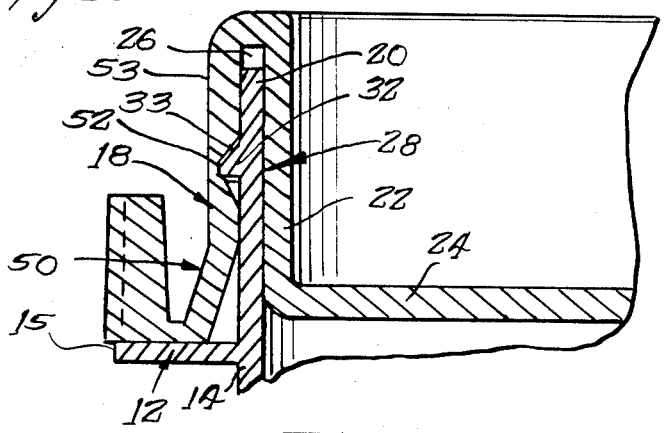
FIG. 10 is an enlarged cross-sectional view taken substantially along the line 10—10 of FIG. 8.

As shown in the drawings for purposes of illustration, the invention is embodied in a container 10 having a closure 11 which is press-fitted and snap-fitted on the container, and in sealing engagement to cover the open mouth of the container. The illustrated and preferred container 10 is formed with an integral security ring 12, sometimes called a "Saturn" ring which is an integral projecting ring or flange which projects radially outwardly from a cylindrical wall 14 (FIG. 10) of the container. The security ring extends generally horizontally from its inner edge which is connected to an inner container wall 14 to an outer peripheral circular edge 15. The closure 11 has a skirt wall 18 which projects downwardly and encircles the rim 20 of the container, as best seen in FIGS. 4A and 10. As illustrated, the rim 20 of the container wall 14 projects upwardly into a generally inverted "U" shaped portion of the closure defined between the skirt 18 and an inverted depending inner leg or wall 22 of the closure. The leg 22 extends downwardly and is integral with a top circular panel 24. The skirt 18 and the inner leg 22 are spaced from each other as shown by the space or gap 26 in FIGS. 9–12. The space 26 is narrower than the distance between the skirt 18 and inner leg 22 such that the closure is frictionally retained on the container when the rim is forced between the skirt and the inner leg.

Additionally, there is a snap-fit interlocking engagement provided between the container and the closure to more positively secure the closure to the container until a tamper-proof band 50 is removed and this comprises an interlocking bead means 28 between the closure and container. Herein, the preferred and illustrated bead means 28 (FIG. 10) comprises an integral outwardly projecting bead 32 on the container which has an upper, inclined surface 33, which slopes downwardly, for example, at 45° which will cam against the skirt wall as will be described in greater detail hereinafter until a recess or groove 36 (FIG. 12) on the skirt 18 is aligned and has received the bead 32, therein. The container rim and bead 32 have been broken away in FIG. 12 to provide a better view of the groove 36. At such time, a lower shoulder 38 on the skirt at the recess 36 abuts a lower generally horizontally extending, lower shoulder 39 on the bead 32 to prevent upward lifting movement of the closure from the container. As readily seen in FIGS. 10–13, a lower edge 40 of the skirt 18 is disposed immediately above and may be in engagement with a top surface 42 of the security ring 12 when the closure is interlocked with the bead on the container.

The security ring 12 will most likely be used in instances where, e.g., where the closure is very flexible, and there is concern that someone could remove the closure by pushing up on the lower edge 40 of the tamper-evident band and push the closure upwardly from the container without tearing off the tamper-evident band 50. In other instances, the person buying the containers may not desire a security ring 12 and rely on the snap-fit engagement of closure to container to hold the closure against someone trying to push against the lower edge 40 of the tamper-evident band 50 and to push the closure off without first removing the tamper-evident band. The present invention is directed to containers with or without the security ring 12 and to alleviating the problem of removal of the closure, after the tamper-evident band has been removed leaving a lower edge 40*a* of the skirt 18 (FIGS. 6 and 7) located adjacent the container bead 50 such that a fingernail inserted below this skirt edge 40*a* hits the container bead 32 thereby making it difficult to lift the closure from the container without the use of a lift tab.

To provide evidence of tampering, it is preferred to provide the tear off or tamper indicating band or strip 50 along a lower portion 51 of the skirt 18 which detaches along the line of weakness 52, which is a thin web 89, from the upper portion 53 of the skirt 18. In the present invention, the line of weakness 52 is at the thinnest, cross section in the skirt and formed at a wall 54 (FIG. 12), which is at the outer, bottom portion of the recess 36. When a user pulls radially outwardly on the tear strip 50, the tear strip readily tears through the thin web 89 located at the bottom wall 54 and separates at this line of weakness 52 in a well-known manner leaving a new, lower edge 40*a* for the skirt 18.

The preferred tear strip 50 has a pull off tab 60 which the user will grasp and pull on to remove the tear strip 50.

Figure 6:
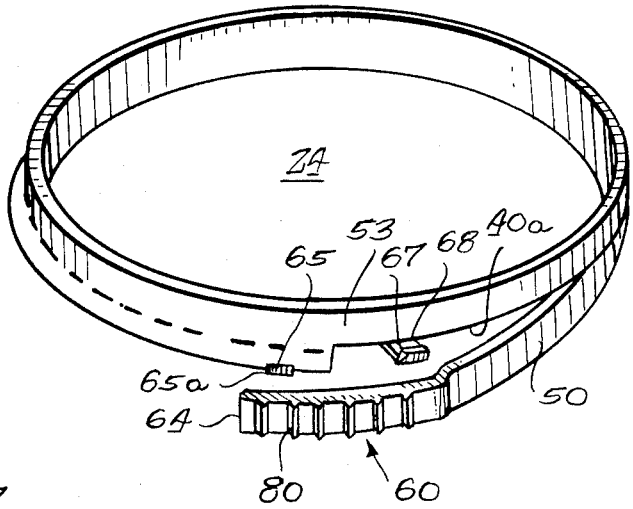
FIG. 6 is a perspective view similar to FIG. 5 but with the pull tab and tear strip partially removed.
Figure 7:
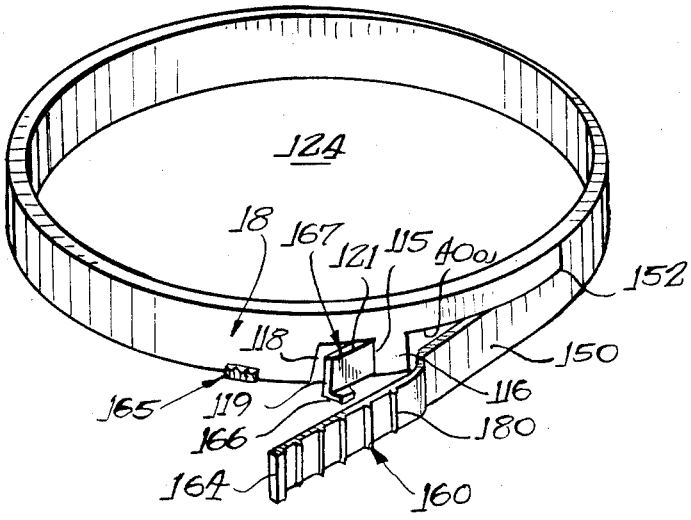
FIG. 7 is a view similar to FIG. 6 but of another embodiment of the invention.
Figure 8:
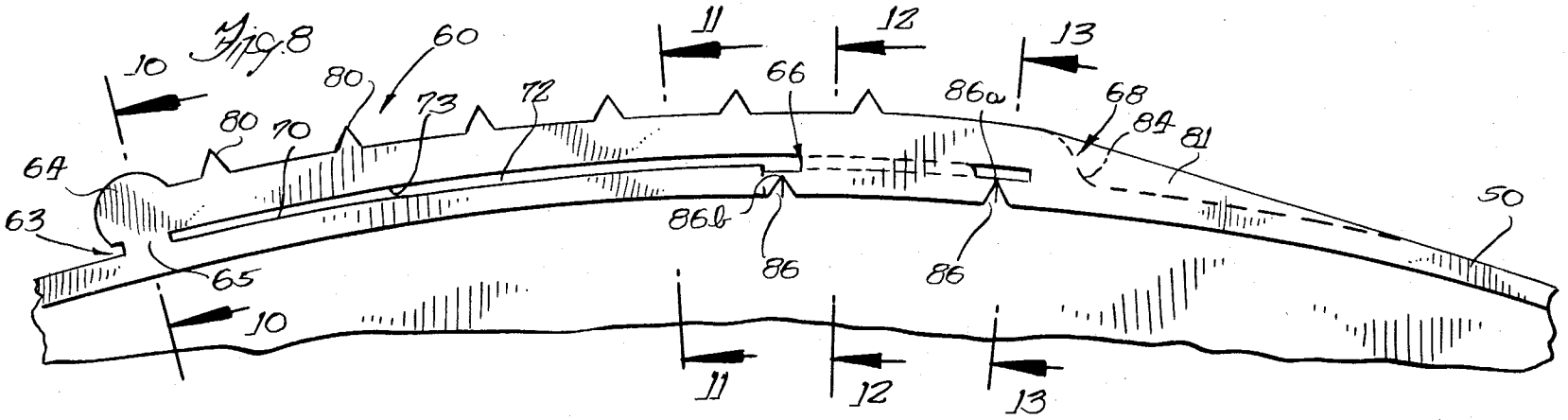
FIG. 8 is an enlarged fragmentary view of the pull tab prior to its detachment.

In accordance with the present invention, there is provided a new and improved one-piece closure having a pull tab 60 to tear off the tear strip 50 and a lift tab 67 which is exposed or made accessible after removal of the tamper-evident tear strip for grasping by the user to lift the closure upwardly from the container. In the preferred embodiment of the invention, the lift off tab 67 is initially hidden behind the pull tab 60 and becomes exposed and accessible after the pull tab is grasped and pulled by the user. Herein, the user will insert a fingernail, or tool, into a slot 63, as best seen in FIG. 8 and will pry outwardly on an enlarged knob or free end 64 of the pull tab to break a frangible bridge 65 (FIG. 7) and then proceed to break a second frangible bridge 66 which is located more closely adjacent a hinge portion 68 which hinges the pull tab to the tear strip. As best seen in FIGS. 6, 7 and 9, the bridge 66 breaks and tears from the pull tab leaving a large lift portion or lift tab 67 for lifting the closure from the container. As the pull tab swings radially outwardly as shown in FIGS. 6, 7 and 9, it pulls the lift tab radially outwardly and also upwardly so that the lift tab remains spaced above the security ring 12 and projecting outwardly of the skirt for easy noticeability and ease of grasping by the person desiring to lift off the closure and to have access to the contents of the container.

Figure 5:
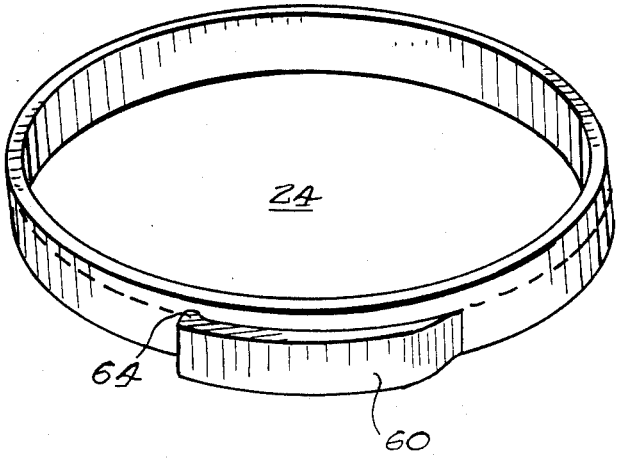
FIG. 5 is a perspective view of the closure having a tear strip and a pull tab constructed in accordance with the preferred embodiment of the invention.

Recapitulating, the pull tab 60 generally covers and hides the lift tab as seen in FIG. 5, and as the pull tab is pulled outwardly it breaks the bridge 65, as seen in FIG. 6 and also breaks the bridge 66; and, during the pulling of the bridge 66 to its breaking point, the bridge pulls the lift tab upwardly and outwardly to insure its exposure or visibility. As best seen in FIGS. 6 and 7, the lift tab 67 is integrally connected at a hinge line or portion to the bottom of the skirt wall 40*a* this hinge line at the web 89 at the bead recess 36 in the skirt. The lift tab 67 shown in FIGS. 6, 7 and 12 includes a tip or portion 66*b* which was part of the bridge 66 and longer body 67*a* which was disposed downwardly in alignment with tamper-evident band 50.

The first frangible bridge 65 is preferably located on the lower edge of the removable tear strip 50 and extends radially outwardly therefrom to an inner vertical wall 70 on the pull tab 60, as best seen in FIG. 8. The frangible bridge 65 usually tears with a small portion 65*a* remaining on the pull tab 60 (FIG. 9) and a small portion 65*b* of the bridge 65 remains on the tear strip 50. The bridges 65 and 66 span a slot 72 (FIG. 8) located between the inner vertical wall 70 of the tear strip and a facing vertical wall 73 of the pull tab. The slot 72 is a thin narrow space extending arcuately, as best seen in FIG. 7, between the bridges 65 and 66. Thus, the pull tab is spaced outwardly of the tear strip 50 by the bridges 65 and 66 and the hinge portion 68.

The illustrated pull tab 60 is preferably provided with some outer vertical ribs or corrugations 80 along its outer surface. The ribs 80 provide a better gripping surface to prevent sliding of the fingers off of the tab. Herein, it is preferred to provide additional strength at the hinge 68 by including an integral horizontal flange portion 81 (FIGS. 8 and 9) extending between the pull tab 60 and the tear strip 50 at the lower edge thereof. The preferred hinge is generally bowed with a generally arcuately shape section 84 adjacent the second bridge 66 which spaces the attached end of the tab radially outwardly from the lower portion of the skirt 18 and causes formation of the slot 72. The preferred second bridge 66 preferably breaks into small portion 66a which remains attached to the pull tab 60, as best seen in FIG. 8, and with a much larger portion 66b which forms an end of the lift tab 67 and is attached to the body 67a of the lift tab 67.

The lift tab 67 of FIGS. 8 and 9 is integrally attached to the tear strip 50 and in alignment therewith and is formed when the tear strip band is separated therefrom at V-shaped notches 86 when the tear strip is removed. More specifically, as shown in FIG. 9, the initial separation of the pull tab 60 and the initial tearing of tear strip along the line of weakness 52 also results in the fracturing a small web 86a (FIG. 8) at the bottom of the notch 86. The web 86a had joined the right side of the lift tab body 67a to adjacent portion of the tear strip 50. The removal of the tear strip is completed when the tear strip is pulled along the line of weakness 52 to the left hand notch 86 at which is a small fracturable web 86b of plastic joining the tear strip to the left side of the lift tab 67.

Figure 11:
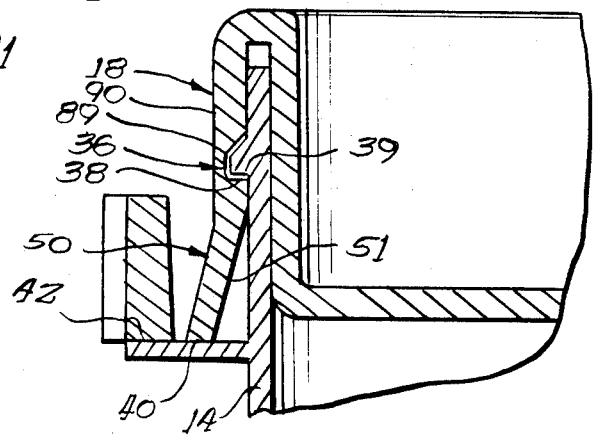
FIG. 11 is an enlarged cross-sectional view taken along the line 11—11 of FIG. 8.
Figure 12:
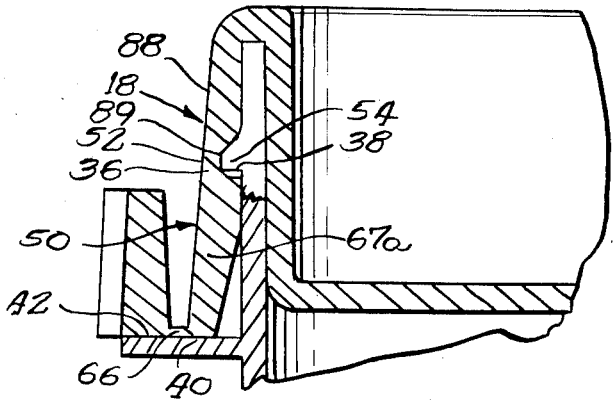
FIG. 12 is cross sectional view taken substantially along the line of 12—12 of FIG. 8.
Figure 13:
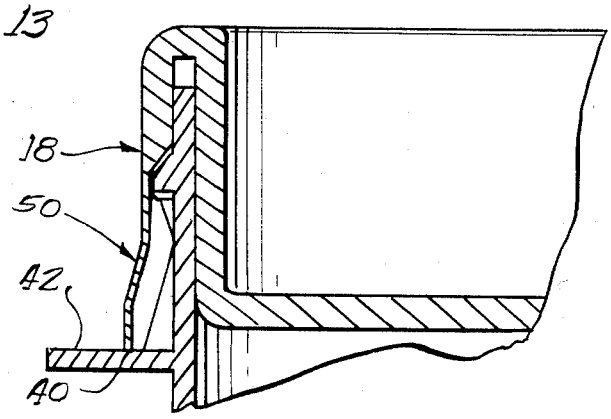
FIG. 13 is an enlarged cross-sectional view taken substantially along the line 13—13 of FIG. 8.

In order to insure further that the pulling of the tear strip 50 doesn't cause a fracturing of the lift tab 67 at the location of the bead receiving groove 36 therein, it is preferred to increase the cross-sectional thickness of the lift tab. As best seen in FIG. 12, the outer side of the lift tab has been formed to come straight downwardly along a surface 88 resulting a thicker web 89 of plastic between the bottom wall 54 of the recess and the outer surface 88. In contrast thereto, the web 89 between the bottom wall 54 and outer surface 90 is much thinner as shown in FIG. 11 which shows a cross section located not at the lift tab. The surface 90 extends substantially more vertically than inclined surface 88. This increased thickness at the web 89 for the lift tab also provides a thicker hinge web 89 so that the lift tab will not break when a strong lift force is being applied thereto. By way of example, the web 89 in FIG. 11 may be about 0.005 inch thick and the web 89 in FIG. 12 may be about twice as thick.

Figure 1:
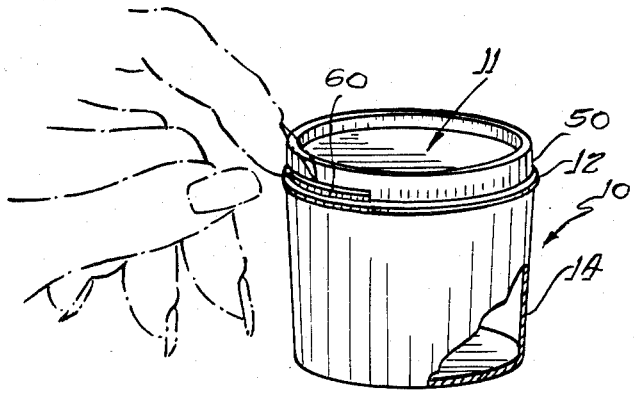
FIG. 1 is a perspective view of a container and closure constructed in accordance with the preferred embodiment of the invention.
Figure 2:
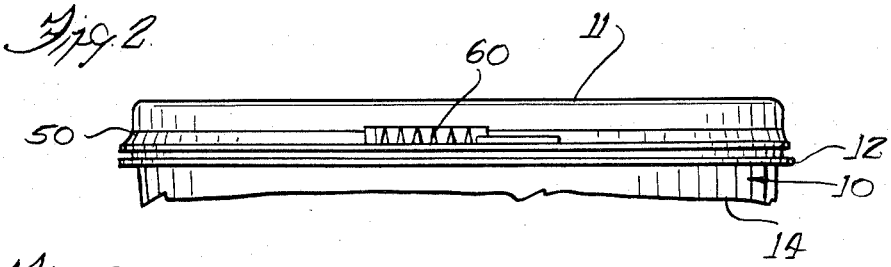
FIG. 2 is an enlarged fragmentary side elevational view of the closure and the top marginal portion of the container.
Figure 3:
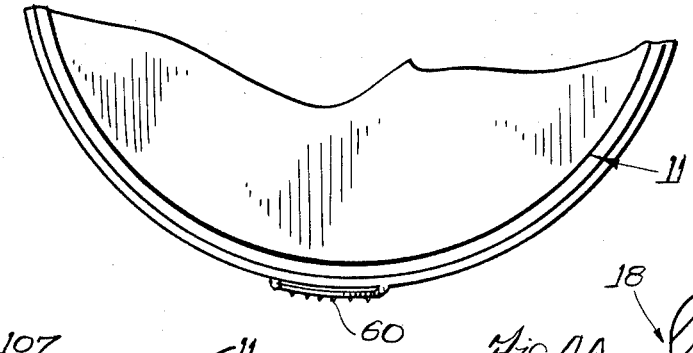
FIG. 3 is a plan view of the closure shown in FIG. 2.
Figure 4:
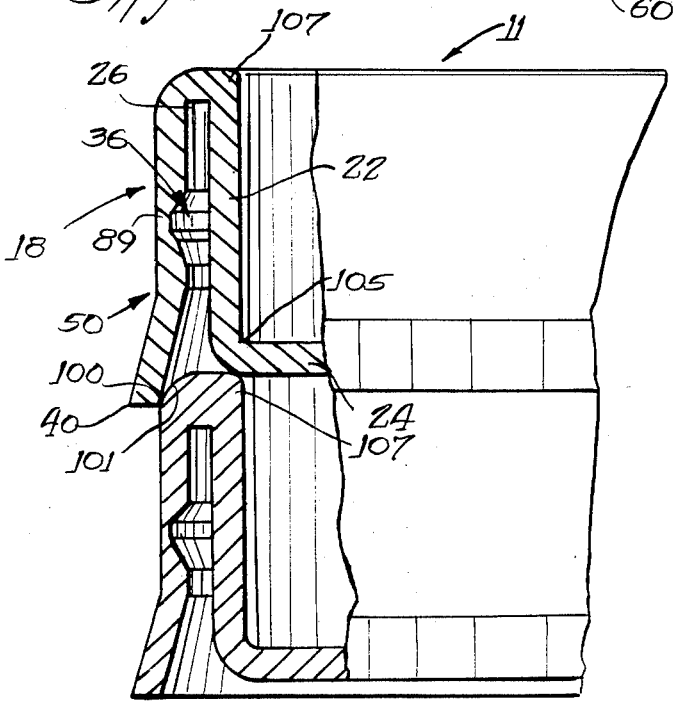
FIG. 4 is a fragmentary view showing the stacking of closures of the invention.
Figure 4A:
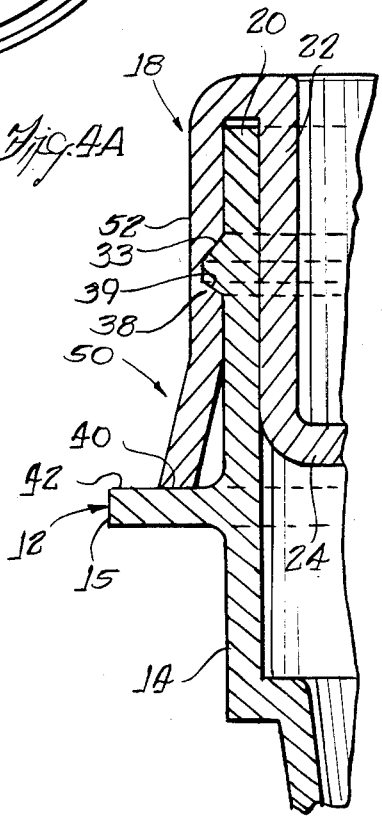
FIG. 4A is an enlarged cross sectional fragmentary view of closure interlocked to a container rim.

The illustrated closures may be readily stacked, as shown in FIG. 4, for automatic feeding and delivering to a capping device which merely pushes the closure down onto the container rim to snap the recess over the container bead to interlock the closure to the container. As best seen in FIG. 4, a lower and inner edge or corner 100 of the skirt 18 abuts and rests on an upper, rounded corner 101 of the closure next below in the stack. A lower corner 105 formed between the inner leg 22 and the central panel 24 rests on the upper circular corner 107 which joins the skirt leg to the inner annular leg 22.

In a further embodiment of the invention illustrated in FIG. 7, a prefix "1" has been added to designate previously described elements as best seen in FIG. 7, a pull tab 160 is detached by pulling the end 164 to break a first bridge 165 for connecting the pull tab to the lower end of the skirt. The pull tab 160 is pulled to remove the tamper-evident band 150 and to form the lift tab 167. More specifically, a frangible second bridge 166 extends between the lift tab 167 and the pull tab 160. The lift tab is hinged along a vertical hinge line 115 to a portion 116 located inwardly of the pull tab. Notches similar to the notches 86 previously described are formed to provide frangible, thin webs which break to form trailing edge 118 of the tear off strip 150 and to form an adjacent vertical side edge 119 for the lift tab. The web 89 located at the bottom wall of the recess may be made thinner at the location of the lift tab so as fracture and leave a top end wall 121 on the lift tab. Because the bridge 166 is stronger than the webs at locations of the tab edges 119 and 121, a pull on the pull tab 160 breaks these webs and forms the pull tab. The portion 116 may be thickened in cross section so that the web 89 is thicker at the portion 116 and therefor will not tear. Thus, a continued pull on the pull tab forms the lift tab and then fractures second bridge 166 before tearing away at the line of weakness 152 at the thin web at the bottom of the groove in the skirt wall to allow removal of the tear strip.

Figure 14:
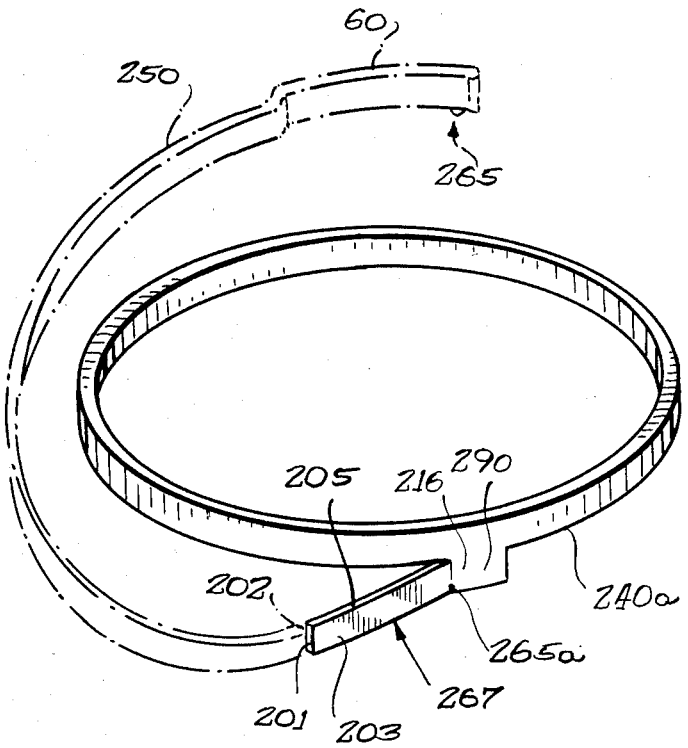
FIG. 14 illustrates a closure constructed in accordance with a still further embodiment of the invention.

In accordance with a still further embodiment of the invention, as illustrated in FIG. 14, the lift tab is formed at the end of the tear strip during its removal from the closure. More specifically, the tear strip (which is shown in phantom) has a pull tab 260 connected by a bridge 265 which tears and leaves a piece 265a. Continued tearing the tear strip 250 from the closure forms the lift tab 267. A notched web 201 formed between and end 202 for the tear strip and an adjacent vertical outer end 203 of the lift tab. The web 201 is thicker and stronger than the web 89 at the bottom of the bead groove at the area of the lift tab so that the web 89 first fractures to form top edge 205 for the lift tab. This causes the lift tab to be pulled radially outwardly for exposure prior to the breaking of the web 201 which then leaves the lift tab as shown in solid lines in FIG. 14. The cross section of plastic at the portion 216 is thickened so that it does not tear and this assures that the web 201 fractures. Thus, to remove the closure, one lifts up on the lift tab 267 which was formed at terminal portion of the tear strip 250 during the removal of the remainder of the tear strip 250 from the closure.

Thus, it will be seen that the closure may be molded in one piece at a high production rate and may be stacked in stacks for automatic handling by a capping machine. The containers are preferably one piece, molded plastic containers with the bead molded thereon. Manifestly, the shape of the bead may be changed from that illustrated. The preferred pull tabs are connected by a small frangible bridge to the closure skirt to prevent interlocking of the pull tabs one with another which can occur when conventional closures are formed with unconnected pull tabs and are packed in bulk containers in a helter-skelter manner.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A closure for a container having a retention bead comprising:

a top panel, a depending skirt extending about periphery of the top panel and extending downwardly and outwardly from said top panel, said skirt having an inner wall and outer wall, a locking recess means on the inner wall of said skirt having a lower shoulder for engaging the lower side of the retention bead on the container to hold the closure on the container, a removable tear strip on the lower portion of the skirt having a line of weakness connection adjacent said locking recess means connecting an upper portion of the skirt to a lower portion of the skirt, said lower shoulder being on said removable tear strip and removed therewith, a pull tab for the removable tear strip molded integrally with the tear strip to be pulled to tear the tear strip at said line of weakness, leaving a lower skirt edge adjacent the container retention bead, and a lift tab connected to the skirt and available with removal of the tear strip and projecting outwardly from the skirt to be used to lift the closure from the container.

2. A closure in accordance with claim 1 in which said pull tab is spaced radially outwardly relative to said tear strip and in which said lift tab is located between said pull tab and said skirt.

3. A closure in accordance with claim 2 in which a frangible bridge extends between upper portion of the skirt and the pull tab.

4. A closure in accordance with claim 1 in which said lift tab is joined to said removable tear strip, frangible means joining said lift tab to said tear strip and being broken to leave said lift tab when said tear strip is detached from the closure.

5. A closure in accordance with claim 3 in which a second frangible means joins said lift tab to said skirt and breaks prior to said first frangible means to allow said lift tab to be pulled radially outwardly from the skirt wall prior to breaking the first frangible means.

6. A closure in accordance with claim 1 in which a frangible tab means connects the lift tab to the pull tab, a hinged portion connecting the lift tab to said skirt, and pulling of the pull tab causing the frangible means to break and to separate from the pull tab and thereby to extend radially outwardly of the container ring for grasping.

7. A closure in accordance with claim 6 in which a frangible connection joins said pull tab to said tear strip and said frangible connection is broken before the frangible means is broken.

8. A closure for a container having a retention bead comprising:

a top panel, a depending skirt extending about periphery of the top panel and extending downwardly and outwardly from said top panel, said skirt having an inner wall and outer wall, a locking bead means on the inner wall of said skirt for interlocking with the retention bead on the container to hold the closure on the container, a removable tear strip on the lower portion of the skirt having a line of weakness connection connecting an upper portion of the skirt to a lower portion of the skirt, a pull tab for the removable tear strip molded integrally with the tear strip, said pull tab having a portion spaced radially outwardly relative to the tear strip, a first frangible bridge extending between the skirt and the pull tab and located adjacent the free end of the pull tab to hold the pull tab inwardly, a hinged end on said pull tab connected to said skirt, said pull tab being biased to swing outwardly about the hinged end, and a lift tab connected to the skirt and exposed with removal of the tear strip and located above said security ring and projecting outwardly from the skirt to be used to lift the closure from the container.

9. A closure in accordance with claim 8 in which said lift tab is located between said pull tab and said skirt.

10. A closure in accordance with claim 9 in which a second frangible bridge extends from the upper portion of the skirt to the pull tab and separates to form said lift tab.

11. A closure in accordance with claim 8 in said second bridge is substantially longer in the circumferential direction than said first bridge.

12. A closure for a container having a retention bead comprising:

a top panel, a depending skirt extending about periphery of the top panel and extending downwardly and outwardly from said top panel, said skirt having an inner wall and outer wall, a locking recess means on the inner wall of said skirt having a lower shoulder for engaging the lower side of the retention bead on the container to hold the closure on the container, a removable tear strip on the lower portion of the skirt having a line of weakness connection at said locking recess means connecting an upper portion of the skirt to a lower portion of the skirt, said lower shoulder being on said removable tear strip and removed therewith, a pull tab for the removable tear strip molded integrally with the tear strip to be pulled to tear the tear strip at said line of weakness, leaving a lower skirt edge adjacent the container retention bead, said tear strip having a secondary tab portion permanently secured to said skirt, a frangible connection joining said secondary tab to said tear strip and breaking with removal of the tear strip to leave the secondary tab for lifting the closure from the container.

13. A closure in accordance with claim 12 in which an upper edge of the secondary tab is connected to the skirt at a line of weakness which fractures before said frangible connection fractures.

14. A closure in accordance with claim 12 in which a frangible bridge connects said pull tab to said secondary tab and is stronger than said frangible connection so that the latter fractures the former fractures.

15. The combination comprising:

a container having an open mouth, a retention bead on said container adjacent the open mouth, a top panel on the closure a depending skirt on the closure extending about periphery of the top panel and extending downwardly and outwardly from said top panel, said skirt having an inner wall and outer wall, a locking recess means on the inner wall of said skirt having a lower shoulder for engaging the lower side of the retention bead on the container to hold the closure on the container, a removable tear strip on the lower portion of the skirt having a line of weakness connection at adjacent said locking recess means connecting an upper portion of the skirt to a lower portion of the skirt, said lower shoulder being on said removable tear strip and removed therewith, a pull tab on the removable tear strip molded integrally with the tear strip to be pulled to tear the tear strip at said line of weakness, leaving a lower skirt edge adjacent the container retention bead, and a lift tab connected to the skirt and available with removal of the tear strip and projecting outwardly from the skirt to be used to lift the closure from the container.

16. The combination comprising:

a plastic container having an open mouth, a plastic closure having a top panel for covering the open mouth of said container, a depending skirt extending about periphery of the top panel and extending downwardly and outwardly from said top panel, said skirt having an inner wall and outer wall, interlocking bead means on the inner wall of said skirt and the wall of said container to hold the closure on the container, a removable tear strip on the lower portion of the skirt having a line of weakness connection connecting an upper portion of the skirt to a lower portion of the skirt, a security ring on said container projecting radially outwardly from the container and located adjacent to and beneath said skirt, a pull tab for the removable tear strip molded integrally with the tear strip, said pull tab having a portion spaced radially outwardly relative to the tear strip, a first frangible bridge extending between the skirt and the pull tab and located adjacent the free end of the pull tab to hold the pull tab inwardly, and a lift tab connected to said skirt and being exposed with pulling of the pull tab and removal of the tear strip.

* * * * *

UNITED STATES PATENT AND TRADEMARK OFFICE

CERTIFICATE OF CORRECTION

PATENT NO. : 4,732,293

DATED : March 22, 1988

INVENTOR(S) : H. RICHARD LANDIS

It is certified that error appears in the above-identified patent and that said Letters Patent is hereby corrected as shown below:

Column 8, Line 46, After "fractures" (first occurrence) insert --before--.

Signed and Sealed this

Ninth Day of August, 1988

*Attest:*

DONALD J. QUIGG

*Attesting Officer*

*Commissioner of Patents and Trademarks*